United States Patent [19]

MacLeod et al.

[11] Patent Number: 4,814,042

[45] Date of Patent: Mar. 21, 1989

[54] METHOD FOR DISCHARGING DELIGNIFIED CELLULOSIC MATERIALS FROM DIGESTERS

[75] Inventors: J. Martin MacLeod, Beaconsfield; Martin E. Cyr, Saint John, both of Canada

[73] Assignee: Pulp & Paper Research Institute of Canada, Pointe Claire, Canada

[21] Appl. No.: 29,028

[22] Filed: Mar. 18, 1987

[51] Int. Cl.[4] ..... D21C 7/08

[52] U.S. Cl. ..... 162/17; 162/52; 162/90

[58] Field of Search ..... 162/246, 52, 17, 90

[56] References Cited

U.S. PATENT DOCUMENTS 1,560,881 11/1925 Ulmen et al. ..... 162/246 X 1,818,913 8/1931 Van De Carr ..... 162/52 X

*Primary Examiner*—Peter Chin

*Assistant Examiner*—Thi Dang

*Attorney, Agent, or Firm*—Lawrence I. Field

[57] ABSTRACT

Lignocellulosic material, after delignification in an alkaline pulping liquor, can be removed from the digester in which it was pulped by first cooling the cooked material and relieving the overpressure from the digester, and then pumping the cooked material from the digester to a receiving vessel as a fluid suspension in spent liquor. When the fluid suspension is pumped at a low flow rate, the pulp thus obtained is superior in its physical properties to pulped material which is discharged under conventional conditions of high pressure and high flow rate from batch or continuous digesters.

11 Claims, No Drawings

METHOD FOR DISCHARGING DELIGNIFIED CELLULOSIC MATERIALS FROM DIGESTERS

FIELD OF THE INVENTION

This invention relates to an improved method of discharging delignified lignocellulosic materials from digesters at the end of alkaline pulping. Specifically, the invention relates to a method of obtaining superior physical strength properties of pulped materials compared to those which are discharged from either batch or continuous digesters in conventional mill conditions of high pressure drops and high flow rates.

BACKGROUND OF THE INVENTION

In alkaline pulping operations, the wood material (softwoods or hardwoods) or the lignocellulosic crop material (e.g., bagasse, kenaf, reeds, and so forth) is reacted with an alkaline cooking liquor for a given time at a specified temperature. The cooking liquor may be kraft, soda, alkaline, sulfite, polysulfide, or their modifications, such as with anthraquinone. At the desired terminating point of the delignification reaction, the cooked material still resides at high pressure and high temperature inside the digester. This is true whether the pulping process is batchwise or continuous.

Some cooling of the cooked material may then be obtained if cooler spent liquor is used to displace the hot spent liquor inside and surrounding the delignified material. This is done routinely in the countercurrent wash zones of many continuous digesters, but is uncommon in batch digester systems.

With or without prior cooling, in both batch and continuous digester operations, the delignified material is then discharged under pressure (i.e., "blown") from the digester through a pipeline and is collected in a receiving vessel which is essentially at atmospheric pressure. Hence, the pulped material is subjected to a large pressure drop during its passage from the digester to the receiving vessel. The receiving vessel is usually a blow tank in batch digester operations; it may be a blow tank or a diffusion washer in continuous digester operations.

Alkaline pulping processes, and especially kraft pulping, are the dominant means of producing cellulosic pulps worldwide. The main reason is that kraft pulping provides pulp fibers which are stronger than those from any other commercial pulping process. Even so, a serious consequence of discharging the delignified material at high pressures and high flow rates from digesters in kraft pulp mills is that the fibers experience considerable physical damage during their transfer from the pressurized pulping vessel to the unpressurized receiving vessel. This phenomenon was reported at the Canadian Pulp & Paper Association Technical Section Annual Meeting in Montreal, Quebec, Jan. 29, 1986 (J. M. MacLeod et al., Conference Proceedings, pp. A31–A37). It was shown that conventional blowing of digesters results in a substantial loss of mechanical strength of the fibers and the paper made from these fibers. This strength loss takes place during the process of blowing cooked material from both batch and continuous digesters.

There are two common means of determining the potential strength of pulp from a given pulping process. One is to conduct a well-controlled laboratory or pilot-plant cook of the lignocellulosic material under suitable chemical and process conditions. At the end of such a cook, after the pressure has been fully relieved and the temperature has fallen below 100° C., the delignified material is removed manually from the small-scale digester and, under mild agitation, is disintegrated into pulp. Pulp produced in this way is the strongest possible from the lignocellulosic material which was delignified, and such pulp serves as a reference material against which the strength of a mill-made pulp can be compared.

The other means to determine the potential strength of a pulp is to use the hanging basket technique: a small, perforated basket containing the material to be pulped is suspended inside a mill digester during otherwise normal operating conditions, and the delignified material is retrieved from the basket only after all the surrounding material has been discharged from the digester. Although such basket pulps are usually slightly weaker than pilot-plant pulps, they are considerably stronger than pulps discharged by blowing from mill digesters.

Both the pilot-plant and basket procedures provide reference pulps against which the strength levels of mill-made pulps can be evaluated. Considering the superior quality of pilot-plant and basket pulps relative to conventionally-discharged mill-made pulps, it was desired to improve the latter by finding a suitable means of discharging the delignified material from mill digesters.

Although other methods of removing delignified cellulosic materials from digesters at the end of pulping have been proposed, none has been implemented in general practice in mills. For example, Gloersen and Ronnholm (Swedish Pat. No. 2407/78) propose a rotary valve arrangement which in its rotation would alternately discharge either spent liquor or delignified cellulosic material plus its entrained liquor from a batch digester. Neno (U.S. Pat. No. 4,138,311) describes a system in which an additional blow tank would be interposed between batch digesters and a conventional blow tank, the additional blow tank being operated at a pressure intermediate between the high pressure in the digester and the atmospheric pressure in the normal blow tank.

The most common means of discharging continuous digesters employs paddle-like scrapers, an outlet device, and valves and piping through which the cooked material is transferred to a receiving vessel which is maintained at atmospheric pressure. Variations on this theme have been proposed, such as in U.S. Pat. No. 3,579,421, where two discharge techniques are employed to feed separate pulp outlets at the bottom of a single continuous digester.

None of these, nor any of the common methods of discharging batch or continuous digesters, however, is able to transfer the cooked material from the digester to the blow tank or receiving vessel without imparting considerable physical damage to the cooked material being transferred, such action resulting in much weaker pulp.

In fact, only two main types of digester discharge techniques are in common use in alkaline pulp mills: (i) blowing through a valve and piping to a blow tank at atmospheric pressure in batch digester operations, and (ii) blowing through a series of depressurizing devices, valves, and piping to either a blow tank or a diffusion washer in continuous digester operations. In both of these techniques, the normal result is that the delignified fibers are damaged as they are transferred from the digesters to the receiving vessels, and hence the paper subsequently made from such fibers is inferior in its physical performance.

It is therefore the primary object of this invention to provide a method for discharging delignified cellulosic materials from digesters at the end of alkaline pulping such that the pulp fibers do not sustain severe damage, and thus can be made into paper materials which have superior strength properties.

SUMMARY OF THE INVENTION

In accordance with the invention, there is provided a method for controllably discharging delignified lignocellulosic material from a digester at the end of an alkaline cook. The method comprises the steps of displacing the hot spent liquor inside the digester with cooler spent liquor until the temperature of the digester contents is below 100° C. and the overpressure in the digester is at or near atmospheric pressure, then discharging the delignified material by pumping it at a controlled flow rate from the digester to the receiving vessel as a fluid suspension in spent liquor. The pipe means from the digester to the receiving vessel, and the entry into the latter, are employed to minimize any physical actions which would cause fiber damage. This method significantly reduces the physical damage of fibers which occurs during conventional discharging of digesters, thereby resulting in superior strength properties in the pulp so discharged.

DETAILED DESCRIPTION OF THE INVENTION

In the conventional alkaline pulping of lignocellulosic materials, the raw material (wood or plant materials), in a particulate form such as chips, is charged into the digester; it is accompanied or followed by the addition of the reactive pulping liquor. This reactive liquor can be an aqueous solution of sodium hydroxide, as in soda liquor, or an aqueous solution of sodium hydroxide and sodium sulfide, as in kraft liquor, or an aqueous solution of sodium sulfite, sodium carbonate, and perhaps sodium hydroxide in the case of alkaline sulfite liquor. Any of these pulping liquors can also contain other reactive agents, either organic or inorganic, such as anthraquinone or sodium polysulfide. Some spent liquor from previous cooks may also be added.

The digester is then sealed, and heat is applied by means of direct or indirect steaming. Delignification occurs when the pulping liquor reacts with the lignocellulosic material at high temperatures, typically in the range 150° C. to 180° C. At these high temperatures, high pressures in the range 500 kPa to 1000 kPa are common inside the digesters. The reaction period at high temperature is usually from about 0.5 hours to about 6 hours.

The overpressure in a digester at the end of pulping is normally used to discharge (or "blow") the digester: a valve (i.e., the blow valve) at the bottom of the digester is opened, and the digester contents flow rapidly through a pipeline to the blow tank or receiving vessel. Due to the combined effects of the high temperature of the cooked material, the rapid change in pressure from the digester to the blow tank, and the high velocity of the flow inside the pipeline, the delignified fibers are damaged by this discharge process, and the strength of the resulting pulp is reduced.

It is possible, at the end of the desired delignification period, to relieve most or all of the overpressure in a digester without deliberately moving any of the cooked cellulosic material inside the vessel. For example, this may be done by performing a complete or partial displacement of the liquor inside the digester, such as described in U.S. Pat. No. 4,578,149. This displacement of the hot spent pulping liquor inside the digester by a displacing liquor of lower temperature serves to reduce both the temperature and the pressure inside the digester. If the contents of the digester are cooled to 100° C. or less, then no significant pressure remains in the digester.

To discharge this cooler delignified material from the digester, however, it would normally be necessary to reintroduce a substantial overpressure (e.g., in the form of steam or compressed air) at the top of the digester such that, upon opening the blow valve, the cooked material is forced to flow from the digester to the blow tank at high pressure and relatively high velocity. As a consequence, there is a serious reduction in the strength properties of the resulting pulp.

It has been found by the inventors that the strength properties of the pulps produced by the method of the present invention are improved over those of pulps produced by the above-described conventional methods of discharge. According to this improved method, cooked material in the digester is cooled by a liquor displacement operation, following which, without repressurizing the digester, the delignified material is pumped from the digester to the receiving vessel in a fluid suspension is spent liquor. When this is done under controlled pumping conditions at low velocity, the improved means of discharge results in superior pulp strength because the fibers sustain less damage during their passage from the digester to the receiving vessel.

In a preferred method of the invention, when the overpressure has been relieved from the digester and its contents have been cooled to below 100° C., the delignified material is discharged under suction produced by pump means (and, of course, the force of gravity) through a valve at the bottom of the digester and then through suitable piping attached to the digester and leading to the receiving vessel. The piping and valve are sized such as to create a minimal pressure drop in the fluid suspension as it is discharged from the digester and transferred to the receiving vessel. The pump also acts as a flow regulator for the fluid suspension. The pump is selected and installed such that it controls the velocity of the material being discharged to a relatively low rate, preferably below 15 feet per second. Optimally, the rate of flow of the fluid suspension of material upon discharge from the digester is approximately 10 feet per second, such that the flow rate downstream of the pump is 5 to 8 feet per second.

Preferably, to control the percentage fiber content (i.e., the consistency) of the fluid suspension to be discharged, a fluid such as spent cooking liquor at a temperature below 100° C. is added at a suitable rate to the material being discharged. This spent liquor may be added through the same entry points around the bottom of the digester as are used to inject cooler spent liquor during the step of displacing hot liquor from the digester. The preferred range of consistency of the fluid suspension through the pumping system is 1 to 7 percent. Those skilled in the art will understand, however, that with suitable pump means such as described in Canadian Pat. No. 1,102,604, the consistency could be as high as 15%. A lower consistency of the fluid suspension will reduce the chances of fiber damage due to fiber-to-fiber interactions.

By controlling the pressure and rate of flow of the fluid suspension as it is pumped from the digester to the receiving vessel, turbulence is reduced, which in turn decreases the chances of fiber damage due to fiber-to-pipe-wall contacts, fiber-to-fiber contacts, and the impact of the fluid suspension of cooked material on the target plate of a receiving vessel. The fluid suspension should preferably fall into the receiving tank or enter it at a position and in a manner which minimizes physical impact at the point of entry.

The method of the invention is advantageous because it substantially avoids the damage to pulp fibers which routinely occurs in conventional discharging of digesters. Such damage is considerable, and is not due solely to either the temperature change or to the pressure change experienced by the fibers as they are transferred from the digester through the piping to the receiving vessel.

The following examples demonstrate the degree of fiber damage which routinely occurs in the common techniques of digester discharge in alkaline pulp mills, and how the present invention circumvents most of this damage, thereby resulting in pulp of superior strength. To provide a common basis for comparison, all three examples are based upon wood chip furnishes in which spruce was the major component, but the applicability of the invention is by no means limited solely to a particular wood species, or to woody raw materials, or to a particular type of digester.

EXAMPLE 1

This example shows the levels of pulp strength which are obtained when mill digesters, both batch and continuous, are discharged in the conventional manner (i.e., by "blowing"). For reference purposes, blown and not-blown pilot-plant results are also shown.

Using similar pulping liquors, mill and pilot-plant batch pulps (Table I) were produced at similar kappa numbers. Across a range of strength properties (e.g., burst, tear, tensile breaking length, stretch, zero-span tensile, and so forth), the pilot-plant pulps were found to be considerably stronger than the mill pulps.

The overall mechanical strengths of pulps can be evaluated in graphs of tearing resistance versus tensile breaking length over a range of degrees of beating of the pulps. By this means, it was found that the mill batch pulp listed in Table I had only 71% of the tear-tensile strength of the two pilot-plant pulps. Clearly, the mill-made batch pulp was significantly weaker than the reference pilot-plant pulps made from the mill's chips.

The pulp from the continuous digester was intermediate in strength between the batch mill pulp and the pilot-plant pulps. Nonetheless, it was 20% weaker than the pilot-plant pulps in tear-tensile strength. The fact that it was blown from the continuous digester at a temperature below 100° C. may in and by itself account for some of its strength advantage over the hot-blown batch mill pulp, but the temperature reduction alone does not bring it to the strength level of the pilot-plant pulps. In a continuous digester with inadequate cooling and washing, the loss of strength upon discharge is comparable to that in a typical batch digester case.

We have found that all of the alkaline pulp mills we have studied produce softwood pulps which are at least 15% weaker than pilot-plant reference pulps made from mill chips; in fact, most mill pulps are 25% weaker than their pilot-plant counterparts.

Table I also demonstrates that the discharging of a pilot-plant digester at high temperature and high pressure does not necessarily result in the kind of fiber damage which is always a consequence of blowing from mill digesters.

TABLE I

RESULTS FROM CONVENTIONAL MILL COOKING AND BLOWING vs. PILOT-PLANT REFERENCE COOKS.

| | MILL | | PILOT-PLANT[a] | |
|---|---|---|---|---|
| Type of operation | BATCH | CONTINUOUS | BATCH | BATCH |
| Type of cook[b] | Kraft | Kraft[c] | Kraft | Kraft |
| Total pulp yield, % | [d] | [d] | 49.8 | 48.6 |
| Kappa number | 32.1 | 30.0 | 31.7 | 31.9 |
| Viscosity, mPa.s | 28.5 | [d] | [d] | 36.4 |
| Means of discharging the digester | Blown | Blown | Blown | NOT blown |
| Temperature of cooked material at discharge, °C. | 172 | ~90 | 170 | <100 |
| Pressure in digester at discharge, kPa | 590 | 1030 | 590 | 0 |
| Pulp strength: | | | | |
| Tear index at 11 km breaking length, mN · m²/g | 9.5 | 10.7 | 13.4 | 13.4 |
| Percent of pilot-plant tear-tensile strength | 71 | 80 | 100 | 100 |

[a]Softwood chips taken from the batch mill's chip supply were used to produce the pilot-plant pulps.
[b]Pulping conditions were: 17.8–18.0% active alkali on wood; 27–32% sulfidity; 90 minutes to maximum cooking temperature of 170–172° C.; 75–88 minutes at maximum temperature; liquor/wood ratio of 4/1.
[c]This continuous digester was running at upper and lower cooking zone temperatures of 155° C. and 165° C., respectively; the chemical conditions were comparable to those stated in footnote b above.
[d]Unknown.

EXAMPLE 2

This example illustrates the level of pulp strength which is obtained when the delignified material inside a mill's batch digester is cooled by liquor displacement prior to blowing.

The two mill batch digester cases shown in Table II represent the same digester when operated either (1) under conventional discharge conditions of hot, pressurized blowing at 172° C., or (2) under so-called "cold-blow" discharge conditions. In the latter case, a liquor displacement sequence was used to cool the contents of the digester to below 100° C., a substantial overpressure was reintroduced at the top of the digester, and then the cooked material was blown from the vessel. A procedure of this general type is described in U.S. Pat. No. 4,578,149.

It was found that cooling the cooked material in the digester prior to blowing (Case 2 in Table II) provided pulp with virtually no improvement across a range of physical strength properties. In tear-tensile strength, both batch mill pulps were at least 30% weaker than the pilot-plant reference pulp, regardless of the temperature of blowing.

Thus, lowering the temperature of the coked material to be blown from the digester is not, on its own, a means of achieving superior pulp strength. Blowing the delignified material at high pressure and at a high flow rate still causes substantial fiber damage and inferior pulp strength.

TABLE II

RESULTS FROM CONVENTIONAL MILL BLOWING, LIQUOR DISPLACEMENT PRIOR TO BLOWING, AND AN UNBLOWN PILOT-PLANT REFERENCE COOK.

| | MILL | | PILOT- |
|---|---|---|---|
| | Case 1 | Case 2 | PLANT[a] |
| Type of operation | BATCH | BATCH | BATCH |
| Type of cook[b] | Kraft | Kraft | Kraft |
| Total pulp yield, % | [c] | [c] | 48.5 |
| Kappa number | 32.1 | 31.8 | 31.3 |
| Viscosity, mPa.s | 28.5 | 36.3 | 37.8 |
| Means of discharging the digester | Blown | Blown[d] | NOT blown |
| Temperature of cooked material at discharge, °C. | 172 | ~85 | <100 |
| Pressure in digester at discharge, kPa | 590 | 590 | 0 |
| Pulp strength: | | | |
| Tear index at 11 km breaking length, mN · m²/g | 9.5 | 10.0 | 14.4 |
| Percent of pilot-plant tear-tensile strength | 66 | 69 | 100 |

[a]Softwood chips taken from the mill's chip supply were used to produce the pilot-plant pulp.
[b]Pulping conditions were: 17.8–19.0% active alkali on wood; 27–31% sulfidity; 85–90 minutes to maximum cooking temperature of 172° C.; 70–75 minutes at maximum temperature; liquor/wood ratio of 4/1.
[c]Unknown.
[d]The hot spent liquor inside this digester at the end of cooking was displaced with cooler spent liquor at a temperature below 100° C. prior to blowing. An overpressure was reintroduced into the digester by connecting its gas phase (headspace) to that of the pressurized accumulator into which the hot cooking liquor was displaced.

EXAMPLE 3

This example illustrates a preferred embodiment of the present invention: at the end of pulping, a mill's batch digester was subjected to liquor displacement to reduce the temperature of its contents; in doing so, the overpressure was relieved from the digester; then the cooked material was pumped from the digester to the blow tank as a fluid suspension of fibers in spent liquor. The pumping was done at a low and controlled flow rate.

Table III provides the relevant data demonstrating that superior pulp strength was obtained by this method of discharge. As was shown in Table II, hot blowing at 172° C. produced pulp that was much weaker than the pilot-plant reference pulp (only 65% of the pilot-plant pulp's tear-tensile strength, for example). If, instead, the mill batch cook was terminated by a liquor displacement operation which reduced the temperature of the digester contents to less than 100° C. and the over-pressure in the digester to atmospheric pressure, and then the cooked material was pumped from the digester as a fluid suspension of fibers in spent liquor, the pulp so obtained was much stronger (86% of the strength of the pilot-plant reference pulp).

In this example, once the liquor displacement was completed, further spent liquor was added near the bottom of the digester to dilute the cooked material, and the fluid suspension was pumped from the digester to the blow tank at 4% consistency and at a controlled flow velocity of less than 15 feet per second. This discharge technique caused the tear-tensile strength of the pulp to improve from 65% of the pilot-plant reference level up to 86% of the reference level. This result is nearly at the level of the best pulp strength normally achieved in this mill, namely the 90% tear-tensile level found in never-blown basket pulps taken from inside the digesters.

TABLE III

RESULTS FROM CONVENTIONAL MILL BLOWING, LIQUOR DISPLACEMENT FOLLOWED BY PUMPING, AND AN UNBLOWN PILOT-PLANT REFERENCE COOK.

| | MILL | | PILOT-PLANT[a] |
|---|---|---|---|
| Type of operation | BATCH | BATCH | BATCH |
| Type of cook[b] | Kraft | Kraft | Kraft |
| Total pulp yield, % | [c] | [c] | 49.8 |
| Kappa number | 32.1 | 35.7 | 35.8 |
| Viscosity, mPa.s | 28.5 | [c] | [c] |
| Means of discharging the digester | Blown | PUMPED[d] | NOT blown |
| Temperature of cooked material at discharge, °C. | 172 | <100 | <100 |
| Pressure in digester at discharge, kPa | 590 | 0 | 0 |
| Pulp strength: | | | |
| Tear index at 11 km breaking length, mN · m²/g | 9.5 | 12.6 | 14.6 |
| Percent of pilot-plant tear-tensile strength | 65 | 86 | 100 |

[a]Softwood chips taken from the mill's chip supply were used to produce the pilot-plant pulp.
[b]Pulping conditions were: 17.8–19.0% active alkali on wood; 27–32% sulfidity; 90–97 minutes to maximum cooking temperature; of 172° C.; 50–75 minutes at maximum temperature, liquor/wood ratio of 4/1.
[c]Unknown. suspension of cooked pulp fibers.

What is claimed is:

1. In a pressurized alkaline cooking process, an improved method of discharging delignified cellulosic material from a digester at the end of the pressurized alkaline cook, comprising the steps of cooling the cooked material inside the digester to below 100° C., substantially relieving the overpressure in the digester, and then pumping the cooked material from the digester, as a fluid suspension of cooked material in spent liquor wherein the flow veocity of the cooked material as it is discharged from the digester is maintained at less than fifteen feet per second.

2. A method according to claim 1 wherein the step of cooling the cooked material inside the digester comprises displacing the hot spent cooking liquor with cooler spent liquor until the temperature of the digester contents is below 100° C. and the overpressure inside the digester is about atmospheric pressure.

3. A method according to claim 2 wherein the flow velocity of the fluid suspension of cooked material is maintained at less than ten feet per second.

4. A method according to claim 1 wherein the fluid suspension of cooked material is pumped from the digester at a consistency of between 1% and 15%.

5. A method according to claim 1 wherein the step of pumping the fluid suspension of cooked material from the digester comprises pumping the cooked material through pipe means such that said cooked material enters a receiving vessel with minimal physical impact.

6. A method according to claim 1 comprising the step of diluting the cooked material as it is discharged from the digester such that the consistency of the fluid suspension of cooked material is in the range of from 1% to 7%.

7. A method according to claim 1 whereby the consistency of the fluid suspension of cooked material upon discharge from the digester is in the range of from 7% to 15%.

8. In a pressurized alkaline pulping process, an improved method for reducing the physical damage to delignified material during discharge from digesters following the completion of pressurized alkaline pulping so as to maintain pulp strength, the method comprising the steps:

(a) displacing the hot spent liquor in the digester with an appropriate cooler liquor until the overpressure inside the digester has been reduced to about atmospheric pressure, and the temperature of the digester contents has been reduced to below 100° C.; and (b) pumping the cooked material from the digester as a fluid suspension at a consistency of from 1% to 15% at a velocity below 15 feet per second through pipe means whereby there is a negligible pressure drop between the digester and the pipe means.

9. A method according to claim 8 wherein the flow velocity of the fluid suspension of cooked material being discharged from the digester is less than 10 feet per second.

10. A method according to claim 8 wherein the step of pumping is controlled so that the flow velocity of the fluid suspension of cooked material upon discharge from the digester is regulated.

11. A method according to claim 8 wherein the step of pumping the cooked material from the digester comprises pumping the material as a fluid suspension at a consistency of from 1% to 7%.

* * * * *

UNITED STATES PATENT AND TRADEMARK OFFICE

CERTIFICATE OF CORRECTION

PATENT NO. : 4,814,042

DATED : March 21, 1989

INVENTOR(S) : J. Martin MacLeod and Martin E. Cyr

It is certified that error appears in the above-identified patent and that said Letters Patent is hereby corrected as shown below:

The Assignee should read --Pulp & Paper Research Institute of Canada, Pointe Claire, Canada and Irving Pulp and Paper Limited, Saint John, New Brunswick, Canada--

Column 1, line 21; the comma (,) after "alkaline" should be deleted.

Column 4, line 29; "is spent" should read --in spent--

Column 7, line 8; "coked" should read --cooked--

Column 8, line 35; footnote "c" to Table III should read --[c]Unknown--

Column 8, after line 35; footnote "d" should be added to read --[d]The hot spent liquor inside this digester at the end of cooking was displaced with cooler spent liquor at a temperature below 100°C; further spent liquor was added for dilution, and the contents of the digester were pumped to the receiving vessel as a fluid suspension of cooked pulp fibers--

UNITED STATES PATENT AND TRADEMARK OFFICE

CERTIFICATE OF CORRECTION

PATENT NO. : 4,814,042

DATED : March 21, 1989

INVENTOR(S) : J. Martin MacLeod et al

It is certified that error appears in the above-identified patent and that said Letters Patent is hereby corrected as shown below:

Column 8, line 46 (Claim 1, line 9); "veocity" should read --velocity--

Signed and Sealed this

Fifteenth Day of August, 1989

*Attest:*

*Attesting Officer*

DONALD J. QUIGG

*Commissioner of Patents and Trademarks*